US010472219B2

(12) United States Patent
Applegate et al.

(10) Patent No.: US 10,472,219 B2
(45) Date of Patent: Nov. 12, 2019

(54) AGRICULTURAL CONTAINER PROCESSING AND RECONCILIATION SYSTEM

(71) Applicants: Doug Applegate, Oakland, IA (US); Luke Applegate, Shelby, IA (US); Brent Applegate, Shelby, IA (US)

(72) Inventors: Doug Applegate, Oakland, IA (US); Luke Applegate, Shelby, IA (US); Brent Applegate, Shelby, IA (US)

(73) Assignee: PRAXIDYN IP HOLDINGS, LLC, Oakland, IA (US)

( * ) Notice: Subject to any disclaimer, the term of this patent is extended or adjusted under 35 U.S.C. 154(b) by 0 days.

(21) Appl. No.: 15/667,548

(22) Filed: Aug. 2, 2017

(65) Prior Publication Data

US 2018/0037450 A1 Feb. 8, 2018

Related U.S. Application Data

(60) Provisional application No. 62/369,890, filed on Aug. 2, 2016.

(51) Int. Cl.
*B67D 7/14* (2010.01)
*B67D 7/72* (2010.01)
*B67C 9/00* (2006.01)

(52) U.S. Cl.
CPC ..... *B67C 9/00* (2013.01); *B67D 7/145* (2013.01); *B67D 7/72* (2013.01)

(58) Field of Classification Search
CPC ..... B67C 9/00; B67D 7/145; B67D 7/72
USPC ..... 222/58
See application file for complete search history.

(56) References Cited

U.S. PATENT DOCUMENTS 3,348,737 A * 10/1967 Yingst ..... B67D 1/0036 137/606
4,830,508 A * 5/1989 Higuchi ..... B01F 13/1055 137/88
4,976,137 A * 12/1990 Decker ..... B01F 13/1055 222/23
5,103,401 A * 4/1992 Johnson ..... G05D 7/0623 177/105
5,203,366 A * 4/1993 Czeck ..... B01F 3/088 137/3
5,288,145 A * 2/1994 Mackey ..... B01F 15/0445 222/58
5,332,311 A * 7/1994 Volk, Jr. ..... B01F 3/088 222/148
5,340,211 A * 8/1994 Pratt ..... A01K 5/0216 222/57
5,558,435 A * 9/1996 Marjo ..... B01F 15/00428 366/141
5,609,417 A * 3/1997 Otte ..... B01F 5/0256 366/137

(Continued)

*Primary Examiner* — Paul R Durand
*Assistant Examiner* — Michael J. Melaragno
(74) *Attorney, Agent, or Firm* — Camille L. Urban; BrownWinick Law Firm

(57) ABSTRACT

The present invention relates to automated batch making assemblies where various component materials, at least, some in liquid form, are combined. Specifically, the invention provides a dispensing assembly that adds efficiency by increasing dramatically the speed with which a liquid is dispensed from a container and by providing means and methods to automate the addition of and account for the amount of each component.

8 Claims, 5 Drawing Sheets

(56) References Cited

U.S. PATENT DOCUMENTS 6,834,777 B2 * 12/2004 Osterheld ..... H01L 21/67253 222/335
6,969,190 B1 * 11/2005 McClain ..... B01F 13/1055 366/141
7,845,516 B2 * 12/2010 Pessin ..... B65G 65/34 222/58
8,245,889 B1 * 8/2012 Starns ..... B67D 7/0238 222/399
8,504,211 B2 * 8/2013 Applegate ..... A01C 21/00 180/14.5
8,744,633 B2 * 6/2014 Applegate ..... A01C 21/00 224/519
8,944,286 B2 * 2/2015 Mehus ..... A47L 15/449 222/58
9,051,163 B2 * 6/2015 Mehus ..... B67D 7/02
2007/0083293 A1 * 4/2007 Applegate ..... A01B 79/005 700/282
2009/0069934 A1 * 3/2009 Newman ..... B67D 1/0021 700/239
2009/0134997 A1 * 5/2009 Godlewski ..... G06Q 10/087 340/539.1
2010/0024915 A1 * 2/2010 Thomas ..... A47L 13/50 141/69
2010/0147876 A1 * 6/2010 Mehus ..... G01G 3/14 222/1
2010/0163573 A1 * 7/2010 Wegelin ..... B67D 1/0078 222/1
2011/0035055 A1 * 2/2011 Applegate ..... A01B 79/005 700/265
2011/0082595 A1 * 4/2011 Mehus ..... B67D 7/02 700/283
2011/0220677 A1 * 9/2011 Bertolani ..... B60P 1/42 222/1
2012/0048883 A1 * 3/2012 Heckenberger ..... A61L 2/26 222/1
2013/0001244 A1 * 1/2013 Wegelin ..... B67D 1/0078 222/1
2014/0017142 A1 * 1/2014 Mehus ..... B01F 15/0445 422/261
2014/0166693 A1 * 6/2014 Williams ..... B65D 83/0005 222/54
2014/0224830 A1 * 8/2014 Maguire ..... B29B 7/88 222/58
2016/0202110 A1 * 7/2016 Johnson ..... G01F 1/76 222/1
2018/0037450 A1 * 2/2018 Applegate ..... B67C 9/00

* cited by examiner

AGRICULTURAL CONTAINER PROCESSING AND RECONCILIATION SYSTEM

CROSS REFERENCE TO RELATED APPLICATIONS

This application claims priority to United States Patent and Trademark Office Provisional Application No. 62/369,890 which was filed on Aug. 2, 2016.

BACKGROUND

Material transfer, materials handling, and batch making of mixtures are required in a multitude of commercial applications. Where those applications are related to agricultural operations, precision farming and other pressures for efficiency have driven a number of improvements, new combinations and other means to track inputs from container and field to crop yielded. Further, certain inputs are very expensive on a per ounce basis driving the need to fully empty containers and account for all of the input.

In agricultural as well as almost every other business, efficiency in terms of time, labor, and product use remains a holy grail worth pursuing.

Liquid materials are often delivered in a jug, with or without a pour spout, and usually with a lid that is removable or displaceable. Efficiency and productivity are reduced by the time required to adequately empty the contents of the jug, especially where the liquid is viscous. The alternative is no more appealing—removing the container before it is adequately drained increases the number of times a container must be loaded and leaves valuable contents in the container as waste or the subject of a second process to remove.

Further, reconciling the amount purchased with the amount used is often heavily influenced by assumptions rather than actual measurements. What was needed was a way to accurately and efficiently empty containers and effectively assure complete emptying and accounting of their contents.

SUMMARY

The present invention is intended for use with an automated batch making assembly that includes a hopper in which a plurality of inputs are combined to form a batch. The apparatus includes means to read information provided on the input's packaging, i.e., RFID or other reader where such packaging is present. Further, the assembly includes a dispensing assembly for managing the input of liquid components. Particularly, the dispensing assembly includes means to release the vacuum that otherwise forms when a container of liquid is inverted to drain and to more fully emptying the container in an efficient manner relative to both time and volume. The invention includes a method for using said dispensing assembly.

Generally, in addition to means to read factory labels provided with the product packaging, the dispensing assembly of the present invention comprises a volume of pressurized gas in a pressurized tank and a volume of rinsate under pressure, and a conduit leading from the pressurized tank and source of rinsate said conduit comprising a first end and a second end. The second end comprises means to dispense said pressurized gas and rinsate; the first end is associated with the pressurized tank and source of rinsate. The means to dispense may be a valve comprising at least an open position and a closed position or, optionally means to adjust the degree to which said valve is opened. A valve is associated with the pressurized gas and a second valve is associated with the rinsate.

The present inventive automated batch making assembly (ABMA) comprising the dispensing assembly provides method and means to fully remove and accurately account for the contents in a container. In one embodiment the ABMA is, generally, a closed system wherein a liquid-containing container is efficiently emptied and its contents fully accounted for. In operation of the inventive means, the speed of the process of emptying or partially emptying liquid from a liquid containing container is markedly increased. Specifically, the full container may be opened and inverted over a nozzle or valve. The nozzle or valve is fluidly associated with the pressurized gas in the tank. The nozzle or valve is opened to dispense the pressurized gas into the liquid-containing container thereby eliminating/reducing the vacuum force otherwise formed when a container of fluid is inverted. Eliminating or reducing the vacuum force causes the liquid to more quickly and more completely evacuate the container.

A conduit having a first end and a second end may fluidly connect the nozzle and the pressurized gas in the tank. The conduit's first end may be associated with the pressurized gas and a source of pressurized liquid such as water to provide means to rinse any remaining contents from the container.

The ABMA preferably also includes a controller. The controller, which may be programmable, records the weight (or the labeled volume of the container which it converts to weight) of the container before the batch is begun, and records (or has previously stored) the weight of the hopper before any liquid is added. In one embodiment, the present invention comprises a reader equipped to read data on an identification tag associated with a container, said data pertaining to the contents in the container, and send that data to the controller where it may be saved.

After the container has been inverted or near inverted and the liquid dispensed as described above, and the controller determines the actual weight after dispensing is consistent with the amount of input expected to be obtained from the container within a predetermined range relative to the labeled container information (or within a predetermined range relative to the known amount in the container as previously recorded by the ABMA if this container was previously partially used), then the controller reconciles the actual weight of the liquid dispensed to the weight as labeled (or the weight as previously recorded for a partial container).

If, after liquid has been dispensed, and the measured weight is determined to be out of the predetermined acceptable range, then the controller records the weight actually measured. Thereafter, the controller causes the nozzle or valve to inject water or other rinsate into the container to wash out the remaining liquid. And, if a container is partially used in one mix and then completely drained and rinsed in another, the controller sums the measurements, compares the sum to a defined acceptable window of error and, if within that window, adjusts the last measured amount so that the total matches the container capacity.

The dispensing assembly described above may also be used for dispensing from containers where the contents need to be transferred via a closed environment. Here, a receiving valve assembly is employed to engage an adaptor cap of a container in which the liquid is housed. As previously described, the assembly may be equipped with a reader to read data on an identification tag associated with the container, said data pertaining to the contents in the container, and send that data to the controller where it may be saved. A load cell weighs at least the container and its contents before transfer and again after. This information is then converted to weight of the transferred liquid thereby recording both the amount used and the amount remaining in that container. The sensitivity of this method can be marginally increased by employing more than one load cell.

In an alternative embodiment, a closed system is provided for direct evacuation of a single container without a hopper. In this embodiment, the input container is associated with an adaptor cap which is, in turn, directly associated with a receiving valve. Pressurized gas and a rinsate supply may be fluidly connected to the receiving valve in order to assist with complete evacuation of the container. A load cell or cells associated with the receiving valve measures the weight of the input and container before dispensing and again after to determine the amount of input received.

In one embodiment, a single container of a given input is opened and used at any given time. In another embodiment, means to uniquely label a container allows the system to uniquely track multiple containers and volumes remaining in each said container of the same input. These unique labels may facilitated reading by a reader such as, but not limited to, an RFID reader.

In embodiments, means to measure fluid moving from a container may include integrated flow measurement devices in addition to or instead of weight detecting devices such as load cells.

The automated batch making assembly and the dispensing assembly, together provide means to track and account for inputs and increase efficiency.

DETAILED DESCRIPTION

Figure 1:
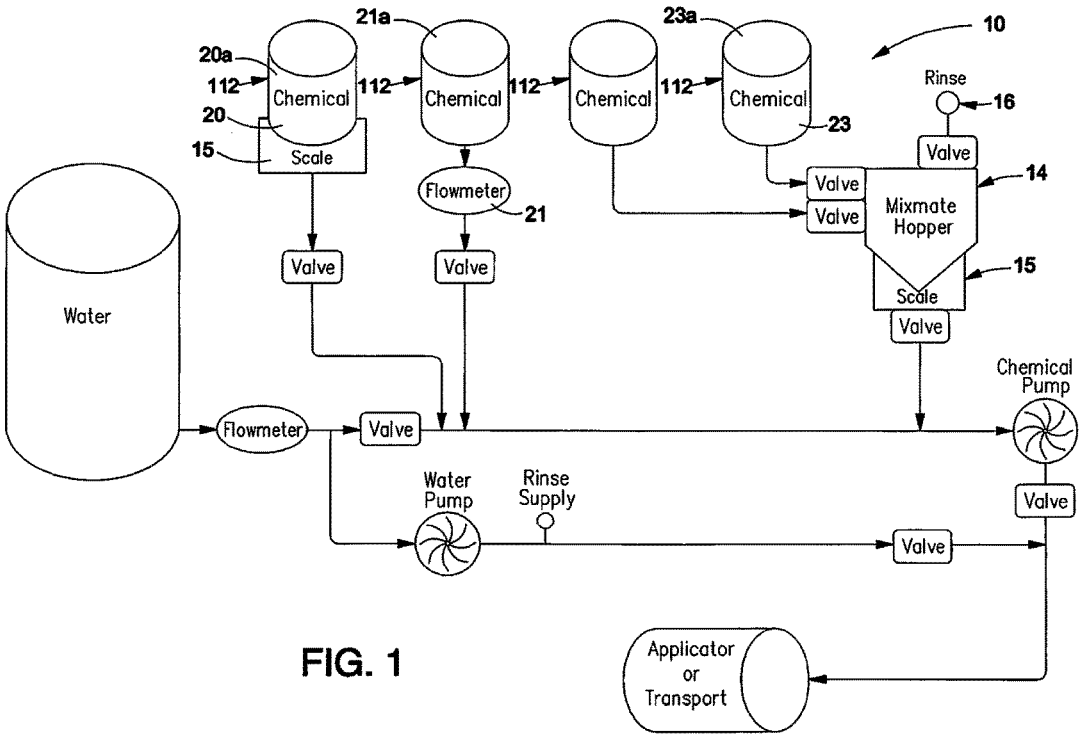
FIG. 1 provides an overview flow chart of the automated batch making assembly.

An automated batch making assembly (ABMA) 10 combines precisely measured liquid components 20-30 or inputs to create a batch combination 50. In addition to the overall objective of precise batch creation, an ABMA assembly 10 should comprise a controller 12 which may be programmable and may comprise a measurement hopper 14 having a rinsing apparatus 16. The hopper 14 further comprises load cells 15 or level measurement sensors 22 or both associated with the controller 12. The ABMA 10 further comprises means to reconcile and account for liquid components 20-30 purchased and used, and a dispensing assembly 40 comprising means to efficiently and adequately remove 52, 56, 59 e.g., liquid components 20, 23 from their containers 20*a*, 23*a*. The containers 20*a*,23*a* may each be provided with a unique container identification 112 which may be electronically readable via RFID or other means or humanly perceived or both. The ABMA preferably comprises a reader such as a bar code reader, well known in the art, to detect the container identification 112 and send it to the controller 12. The controller 12 is equipped to accept the container identification 112 read from the label on containers of inputs, and to reconcile and account for liquid components 20-23 purchased and used from those containers 20*a*-23*a*.

The present invention is focused on the dispensing assembly 40 comprising means to adequately empty containers 20*a*-23*a* of liquid components 20-23 where the liquid is to be used to produce a batch combination 50. It should be understood that the invention may comprise any number of containers.

In a preferred embodiment, the ABMA 10 may be employed as an "open system" where the operator pours measured portions of the contents of a plurality of containers 20*a*-23*a* into the hopper 14. As an example, the hopper 14 may be a stainless steel 12.5 gallon container. A lid 120 may or may not be associated with the automated batch making assembly. Where lid 120 is included it may be mounted on a frame 121 rather than the hopper 14 so that its weight does not effect that of the hopper 14 which will be weighed as means to record the weight of inputs 20-30 added. Alternatively, the lid 120, if present, may be mounted on the hopper 14.

The ABMA 10 may, alternatively, be operated as a closed or semi-closed system to reduce or eliminate exposure to the operator. In this embodiment, the lid 120 may be provided with container connectors 150 located such that the container's weight does not affect the hopper's weight. Alternatively, container connectors 150 may be provided on a frame standing separate from the hopper 14 thereby positioning a container 20*a*-23*a* above but not in physical contact with the hopper 14 so that the container's weight need not be accounted for. A lid 120 may or may not be present. The weight of the hopper 14 is recorded by the controller prior to and again after each input 20-23 is added to the hopper 14. In an alternative embodiment, a flow meter as is known in the art may be associated with the container connector 150 or incorporated therein allowing measurement of inputs to be directly determined in that manner. Preferably, the controller 12 receives and records the readings from the flow meter 21 and/or load cell 15.

In an alternative embodiment, an adapter cap 200 may be associated with the container 20*a*. The adapter cap 200 may comprise a valve assembly. A receiving valve assembly 210 associated with a pressurized gas supply 62, a rinsate supply 110, and at least one load cell 15 is employed. In this embodiment no hopper is included, rather the load cell 15 weighs the combination of the receiving valve assembly 210, the adapter cap 200, and the container 20*a* prior to dispensing from the container 20*a* and again after the desired amount of input 20 is dispensed. The preferred receiving valve assembly 210 is configured to associate the container 20*a* at an angle to facilitate draining of the input 20 from the container. A motor is preferably provided to control the flow of input 20 from the container 20*a* as well as control the pressurized gas 62 and rinsate 110 into the container 20*a*. In short, one or more of the load cell 15 may be replaced by a flow meter 21 integrated in the receiving valve assembly 210. In an alternate arrangement, the receiving valve assembly 210 is associated with the lid and, therefore, does not affect the weight of the hopper.

The closed system ABMA 10 may be manually controlled in response to prompts from the controller 12 or automatically controlled by the controller 12 as it follows a predetermined set of commands to add specified amounts of each component, e.g., 20-23 for a batch 50. The set of commands include routines for draining, rinsing, container ID recordation, and measuring. The automated batch-making assembly (ABMA) facilitates computer-assisted production of batch chemical combinations.

Water is typically employed to facilitate production of a predetermined batch of chemicals 50 and/or to rinse component containers 20*a*-23*a*. The ABMA 10 is computer-assisted and can be programmed to prompt an operator to provide certain inputs 20-23 to the hopper 14. The ABMA may be equipped with means to visually identify, read barcode, RFID, NFC to confirm container identity for inputs/components. As will be described, the ABMA 10 verifies and records those inputs and the volume amounts thereof via measurements provided by the load cells 15 and a routine to be described herein. This information is employed by the ABMA 10 to track inventory even down to the amount remaining in a partially used container 20*a*-23*a*. The more automated version of the ABMA 10 may be equipped to record volumes added and cause various inputs to be added in a particular order. Alternatively or additionally, ABMA 10 may also serve as a prompter to cause an operator to provide or load each input 20-23 in an order and/or amount required. It then records changes in weight which can be reconciled with the amount of each input 20-23 needed. The ABMA 10 provides several advantages over the prior art assemblies and methods.

The dispensing assembly 40 comprises means 56, 52, 59 to remove liquid components 20-23 from their containers 20*a*-23*a*. It should be understood that reference numbers 20-23 are used to describe a number of liquid components. Each of these liquid components are, generally, handled in the same manner by the dispensing assembly 40, therefore we will describe the dispensing assembly relative to a single liquid component 20, its container 20*a* having an opening 20*b* and a closure or lid with the understanding that each liquid component to be handled by the dispensing assembly may also have a container, an opening and a closure or lid.

The dispensing assembly, 40, comprises means 56 to remove liquid components or inputs 20 from their containers 20*a* and addresses a long felt need in the industry. Agricultural inputs have become more concentrated, more powerful, more specialized in their effects and, of course, more expensive. Further, the old adage "time is money" has become evermore applicable to agricultural endeavors.

One advantage provided by the ABMA 10 is facilitated by the dispensing assembly 40. The dispensing assembly 40 facilitates faster flow of liquid out of a container housing 20*a*. To accomplish faster emptying or partial emptying of the container 20*a*, means 56 to efficiently and adequately remove liquid comprises a conduit 52 having a first end and a second end, said second end comprising a valve or other means to start and stop flow through the conduit 52 as is commonly known in the art. The first end of the conduit 52 is fluidly associated with a pressurized tank holding a pressurized gas 62. A valve on the second end of the conduit 52 or otherwise positioned thereon can be opened and closed. The valve may be opened at least partially thereby allowing an amount of the pressurized gas 62 to flow into the conduit 52 for a purpose which will be described.

The container 20*a* housing the liquid component or input 20 comprises an opening 20*b* through which the liquid 20 may be poured or otherwise removed and/or means to form an opening 20*b* through which the liquid may be poured or otherwise removed. Said means to form an opening 20*b* may comprise a threaded association 208 between a closure or lid and the container 20*a* or a snap fit type of relationship between the closure and opening 20*b* in the container 20*a* or other conventional means. Alternatively, said means to form an opening 20*b* may be resealable or may not be resealable, said means may comprise a lid having a material portion that may be separable from the lid and disposed of thereby creating opening and may or may not result in the possibility of re-sealing the container 20*a*. In any event, the container 20*a* will have an opening 20*b* or means to form an opening 20*b*. The container 20*a* additionally comprises an end 20*d* opposite the opening 20*b*. The opening 20*b* provides a path through which liquid inputs 20 housed in the container 20*a* may be poured or otherwise removed.

In one embodiment, the dispensing assembly 40 further comprises means to secure 75 the container 20*a* in an inverted position with the opening 20*b* below the opposite end 20*d*. When inverted, the liquid 20 in the container 20*a* flows toward the opening 20*b*, however, because the opposite end 20*d* of the container 20*a* is sealed, the liquid 20 is unable to flow out or is only able to flow slowly and sporadically out of the opening due to the vacuum force resulting from the liquid 20 pouring out and nothing available to fill the void left in the opposite end 20*d*. This effect is especially pronounced where a viscous liquid is being emptied although the phenomenon occurs regardless of viscosity.

In order to facilitate faster evacuation of the liquid 20 from the container 20*a*, the second end 56 of the conduit 52 which may or may not comprise a nozzle is inserted into the inverted container 20*a* or, alternatively, inserted into the container 20*a* prior to inverting. An amount of the pressurized gas 62 is allowed to flow into the inverted container 20*a*. The gas 62 rises to the opposite end 20*d* which is now positioned above the opening 20*b* thereby eliminating the vacuum force and allowing the liquid 20 to outflow from the container 20*a* much faster, leaving less of the liquid component 20*a* in the container 20. In one embodiment, the pressure of the gas 62 may be adjusted by the operator to apply just enough to relieve the vacuum. Alternatively, the dispensing valve assembly 40 contains a pressure relief valve to not over pressurize the container 20*a* if the operator applies too much pressure.

It should be understood that the container 20*a* does not necessarily have to be inverted. For example, as previously described, the container 20*a* may include means to form an opening. Said means to form an opening 20*b* may be resealable or may not be resealable. In this embodiment, means to secure the container 20*a* is employed to secure the container 20*a* with the openable opening 20*b* above the opposite end, i.e., right side up. Because the opening 20*b* is sealed and opposite end 20*d* of the container is sealed, the liquid 20 is unable to flow out. In this embodiment, the operator may employ any means capable to puncture an opening in the opposite end 20*d* to allow the input 20 to outflow. The input 20 will only be able to flow slowly and sporadically out of the opening due to the vacuum force resulting from the liquid 20 pouring out and nothing available to fill the void left near the means to form an opening. This effect is especially pronounced where a viscous liquid is being emptied although the phenomenon occurs regardless of viscosity. An amount of the pressurized gas 62 is allowed to flow into the container 20*a*. The gas 62 rises to the opposite end 20*b* which is now positioned above the opening 20*d* thereby eliminating the vacuum force and allowing the liquid 20 to outflow from the container 20 much faster, leaving less of the liquid component 20*a* in the container 20. In one embodiment, the pressure of the gas 62 may be adjusted by the operator to apply just enough to relieve the vacuum. Alternatively, the dispensing valve assembly 40 contains a pressure relief valve to not over pressurize the container 20*a* if the operator applies too much pressure.

The automated batch making assembly (ABMA) 10 of the present invention comprising the dispensing assembly 40 is computer-assisted and may be employed in a number of ways. The ABMA 10 may comprise its own monitor and/or screen 80 or may be enabled via laptop or other form of CPU (computer processing unit) associated with the controller 12 or serving as the controller 12. Although not required, employment of a screen 80 to both guide and report is contemplated. One embodiment of the ABMA 10 comprises at least one hopper 14 which may or may not be substantially covered by a lid 120, and a scale 114 comprising load cells 15 for measuring the weight of the hopper 14, the hopper 14 and its contents, or the hopper 14, its contents, and the lid 120. One example method of using this embodiment of the ABMA is as follows:

1. The ABMA 10 is powered up.
2. A preprogrammed set of instruction to form a batch 50 may be accessed and provided to the controller 12 or a set of instructions to form a batch 50 may be input.
3. The monitor/screen 80 shows a vertical bar graph or other indicator with a chemical name to identify the input 20-30 that needs to be added.
4. The operator opens lid 120 of the ABMA 10 to start the process.
5. An empty weight of the hopper 14 is captured.
6. The scale 15 measures and the screen 80 is updated with the current weight of the empty hopper 14. This update may be shown on a graph, chart, numerically, or other visual indicator.
7. The operator opens a container 20*a* of the input 20 and inverts the opening 20*b* over a nozzle 56 which may be associated by the conduit 52 with a pressurized gas 62, pressurized liquid, or with a source for one or both. Alternatively, the container 20*a* is not opened or inverted but, instead, an opening is formed in the opposite end 20*d*.
8. In one embodiment, an ID tag on the container is scanned or read by a reader and the container is weighed before contents are removed. In another embodiment a flow meter is associated with the container 20*a*.
9. As the input 20 leaves the container 20*a*, a vacuum force or pressure is formed therein.
10. A switch 59 for a valve 58 controlling the pressurized gas 62 is activated either by pressure of the container 20*a* as it is over the nozzle 56 or physically tripped by an operator.
11. Upon activation of the switch 59, the valve 56 opens and pressurized gas 62 (typically air) is allowed to flow into the container 20*a*. The pressurized gas 62 rises through the input 20 in the container 20*a* thereby overcoming and diminishing the vacuum force. In one embodiment, the operator may adjust the pressure of the gas
62. In another embodiment, the nozzle 56 is provided with a pressure relief device and, therefore, the pressure of the gas 62 applied may be increased without risk of container 20*a* bursting.
12. The desired amount of liquid 20 is allowed to efficiently leave the container via gravity. In one embodiment, the liquid 20 flows to the hopper 14.
13. In an embodiment, the hopper 14 is weighed after the contents required for this batch are removed from the container 20*a*, and compared with the weight from step 5. The difference between the weight at step 5 and the weight at this step is then recorded by the controller as a container still retaining input and associated with the container ID, thereby providing a running inventory of inputs on a container and volume basis.
14. The weight of the input 20 in the hopper 14 is monitored and when the flow from the container 20*a* stops or nearly stops, the weight of the input 20 in the hopper 14 is captured. In another embodiment, a flowmeter measures the flow from the container 20*a* and communicates to the controller 12 and the controller determines the container 20*a* to be nearly empty taking into consideration the container's known volume of liquid and the measured flow.
15. If the weight of the input as measured or the flow measurement indicates that a volume of input 20 within a predetermined margin around the input's labeled container capacity is within accepted window (this case+−2%, however, it is to be understood that this window can be adjusted in accordance with the user's objectives) it is reconciled to the container capacity and the container is considered empty. If the weight of the input is outside the accepted window, the controller records the measured amount.
16. The system displays a message announcing a rinsing cycle. Rinse water or other rinsate 110 is turned on and a drain valve in the hopper 14 is opened, container 20*a* is over the nozzle, thereby triggering a pressure, light sensitive, or other valve switch 59 thereby activating the rinsate stream 110. The pressurized gas 62 continues during the rinse. This allows for a more active rinse action removing the input 20 more quickly. The pressurized gas 62 helps remove rinsate 110 from the container 20*a* more effectively.
17. Rinsing continues while the container 20*a* is over the nozzle 56.
18. When the container 20*a* is lifted off the rinse nozzle 56 the switch 59 opens and the pressurized gas 62 and rinsate 110 are turned off
19. The weight of the hopper 14 is monitored to maintain a low level in the hopper thereby allowing the addition of multiple containers of the same input or of other inputs without overfilling the hopper. The weight of the hopper is used to modulate the opening of a drain valve in the bottom of the hopper to empty the hopper and to manage the level of inputs in the hopper.
20. After completing the rinse, the drain valve is closed.
21. A new empty weight of the hopper is captured.
22. The screen brightens and the bar graph shows the total measured product.
23. If more chemical is required go to step 7, if not go to step 24.
24. The operator closes the lid, a switch triggers the controller to capture a final weight, save the record, and go to the next input called for by the instructions to form the batch.

Figure 2:
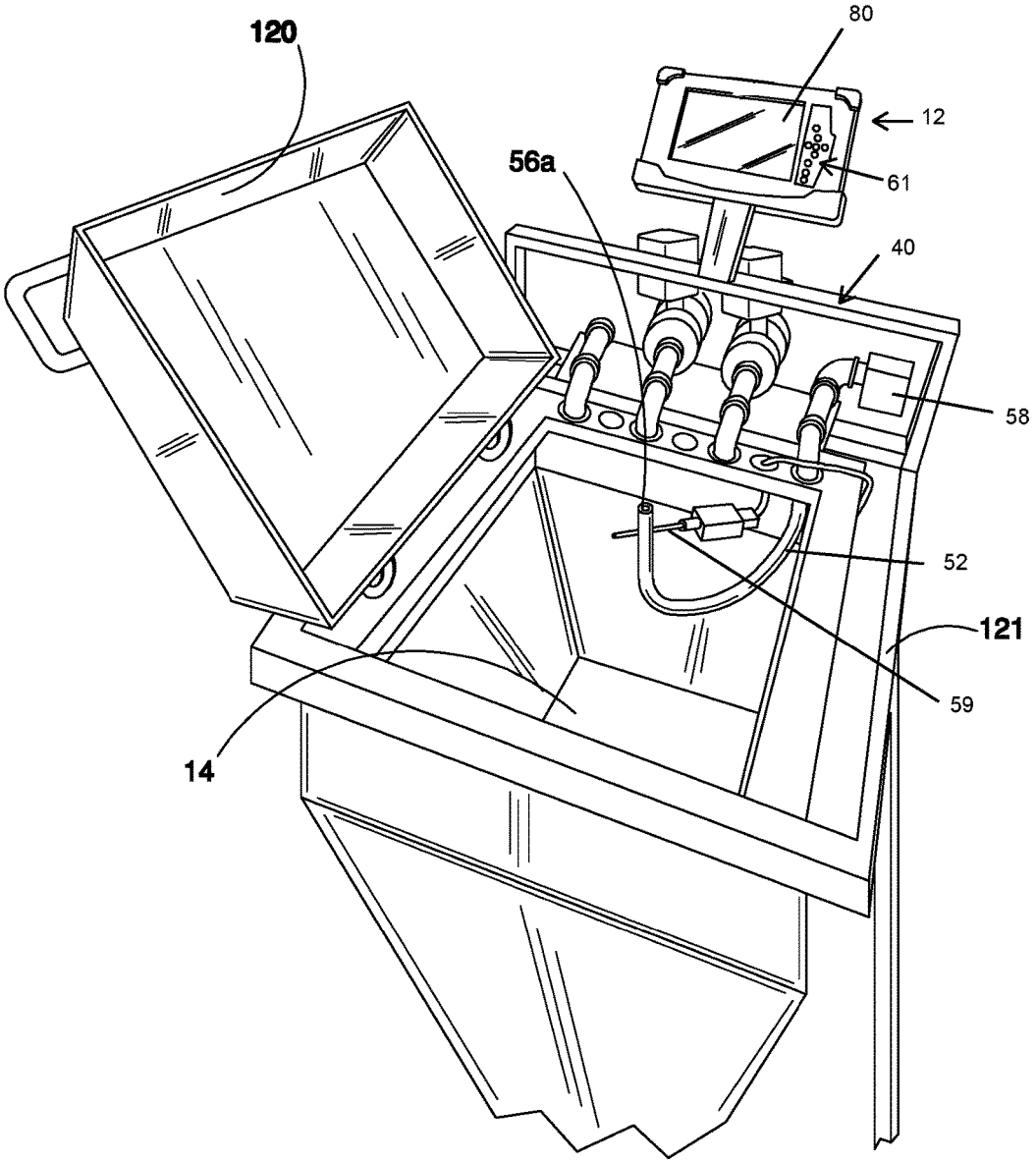
FIG. 2 provides a schematic showing the equipment of the automated batch making assembly.
Figure 3:
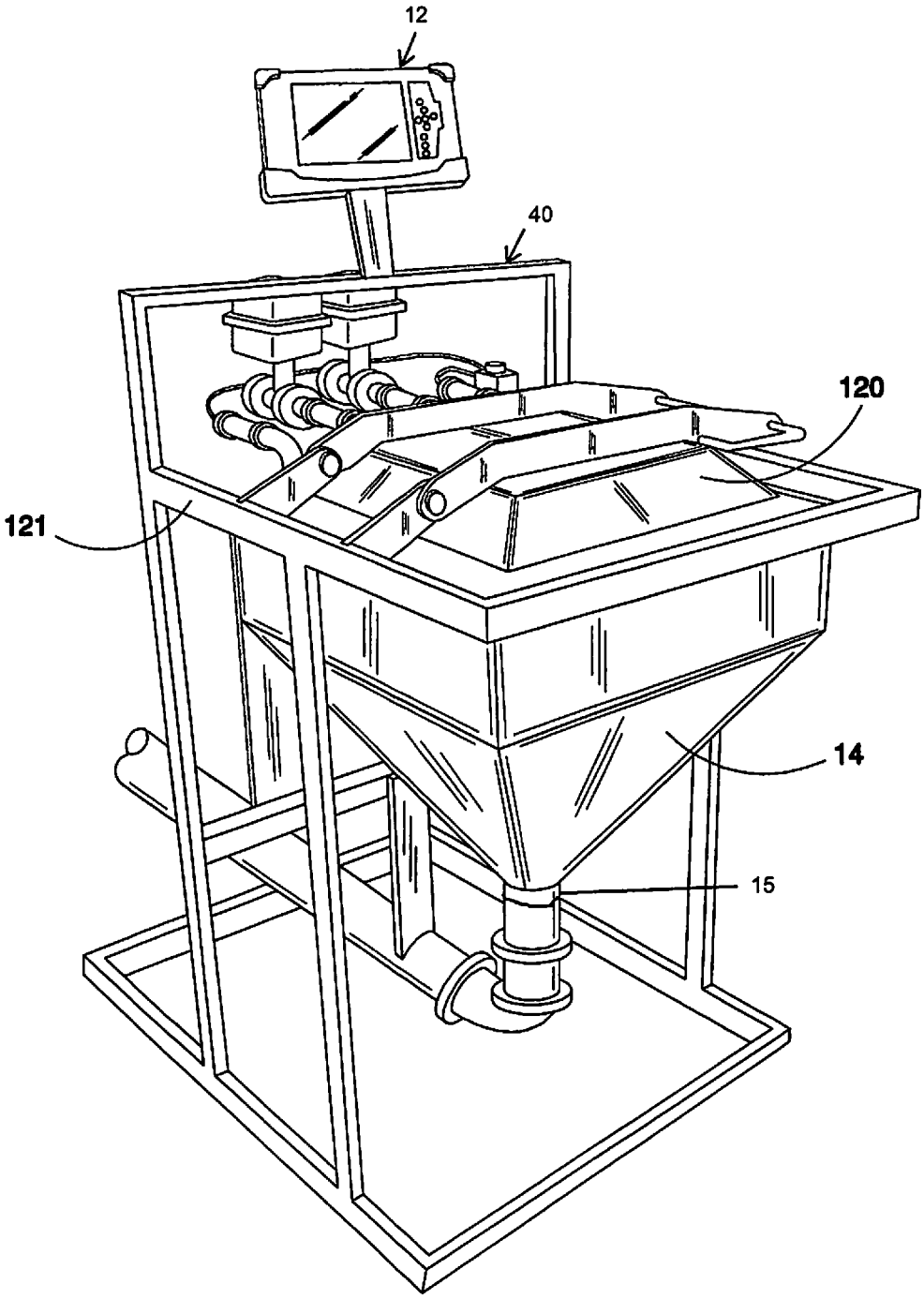
FIG. 3 provides a schematic showing the batch making assembly with the lid open.
Figure 4:
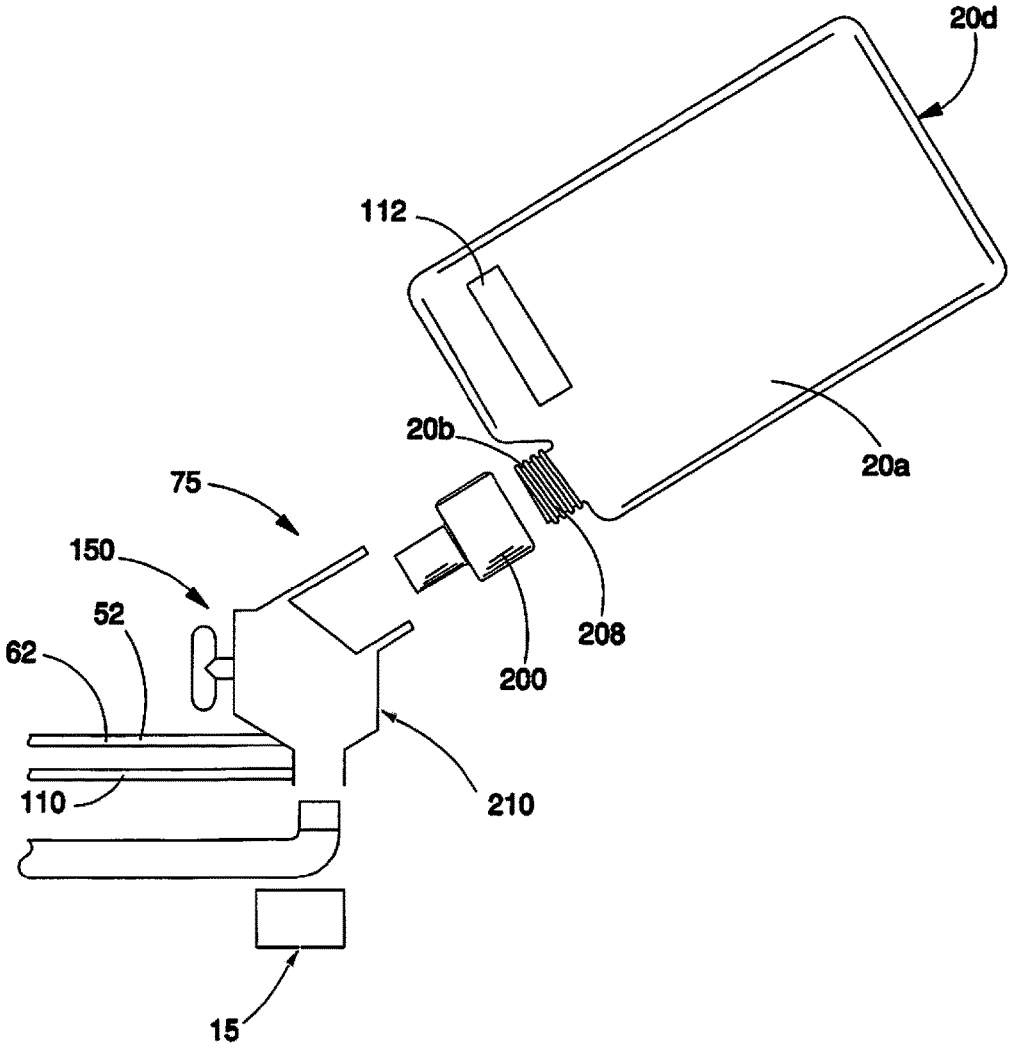
FIG. 4 provides a schematic showing jug, adapter cap, and receiving valve assembly
Figure 5:
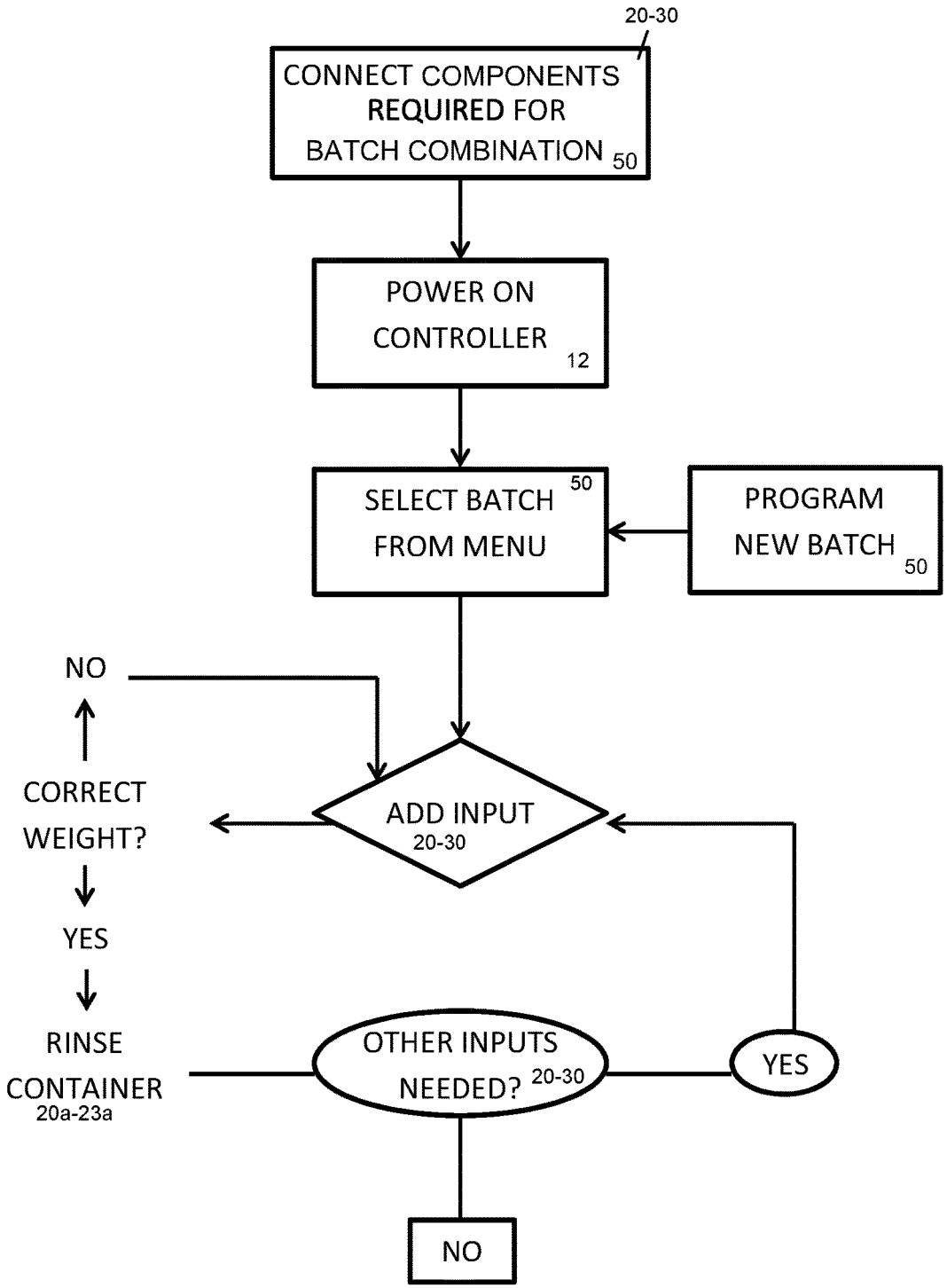
FIG. 5 is a flow chart showing automated batch making assembly.

Referring now to FIGS. 1 and 2, an example embodiment of a method of using the ABMA and the dispensing assembly is shown.

The Dispensing Assembly 40 is associated with or integral with the ABMA 10. The dispensing assembly comprises the conduit 52 for transferring a fluid, or a gas from a pressurized tank, to a container 20*a* to be emptied of fluid input 20 or which is in the process of being emptied. As is known in the art, a pressurized tank may contain pressurized gas 62 such as but not limited to compressed air. The second end 56 of the conduit 52 is equipped with the valve 58 or other means to dispense the gas 62. Said means to dispense the pressurized gas may be one of any number of valves, capable of facilitating an open/closed positions allowing or disallowing flow of the pressurized gas 62 through the conduit 52.

In one embodiment an operator may be directed by the controller of the ABMA by providing a message on the screen to add fluid A. The operator may invert or overturn a container 20*a* full of fluid and secure its position, with its opening 20*b* at the bottom and its opposite end 20*d* at the top. Some of the fluid A may pour out, but its flow rate is known to be unacceptably slow. The operator may insert the second end 56 of the conduit 52 into the opening 20*b* now positioned at the bottom and open the valve 58, thereby causing the pressurized gas 62 to rise through the fluid A, eliminating the vacuum and eliminating the vacuum pressure and thereby allowing fluid A to flow more quickly from its container 20*a*.

Alternatively, the dispensing assembly 40 may include a platform on which the second end 56 of the conduit 52 is mounted or is otherwise associated therewith. In this embodiment, the operator inverts the container 20*a* (opening now on the bottom) over the conduit 52 and secures the container's 20*a* position and then actuates the valve 58 to cause flow of the pressurized gas 62 from the pressurized tank 60 allowing the faster evacuation of the fluid A.

In an alternative embodiment the platform or the conduit 52 is equipped with a pressure sensitive on/off switch 59, such that when the operator inverts the container 20*a* over the conduit 52 and places the inverted container on the frame 121, the pressure on the pressure sensitive on/off switch 59 actuates the valve 58 to cause the flow of pressurized gas 62.

In one embodiment the nozzle 56*a*- or other device on the conduit 52 through which the low pressure gas 62 flows to aid with voiding the container 20*a* is simultaneously associated with a volume of rinse water 110, the nozzle 56 or other device is equipped with a switching means 61 allowing the operator to selectively flow the low pressure gas 62 or a liquid rinse 110, thereby providing an efficient means to rinse out any fluid A remaining in the container 20.

In an embodiment, the controller comprises means to monitor 15 the weight of the container said means may be associated with a platform or other support for the inverted container 20. A measurement of weight is taken from the beginning of transfer of fluid A and when its weight reaches a predetermined number, the controller 12 deems the container 20 empty and ready to rinse; the controller 12 then deactivates the low pressure gas 62 that was used to eliminate the vacuum and activates the rinse liquid 110 for cleaning the container. In a variation of this embodiment, a combination of air and rinse liquid 110 may be employed to clean the container 20; this is faster because less rinse agent 110 is used and time to drain is reduced thereby reducing container process time.

If, after removal from the container of the desired input the container is not empty, a new weight of the container is recorded by the controller and/or a new volume of the input remaining in the container is recorded. Thereafter, if that input is required for another batch, the remainder of that input from that container may be used and the container drained and rinsed at that point. A reconciliation routine is employed. The reconciliation system (1) starts with the known volume or weight of product provided in the container at purchase; (2) measures the volume of the product used in the first batch; (3) measures the volume of the product used in subsequent batches; (4) upon emptying the container, comparison of volume of product used with amount of product as provided by the container label; (5) if within accepted error window, adjusts volume of product used in the last batch to true up to the container label.

In another embodiment the system may be employed with hand-pour containers. This version of the system may include a closed version. Here, an adaptor cap 200 is attached to the container 20*a* and a receiver comprising a valve assembly 210 for the container is mounted over the measuring hopper 14 or, alternatively, may be mounted on the lid. The adaptor cap 200 is received by the receiver or receiving valve assembly 210 creating a fluid container connector between container 20*a* and measuring hopper 14 thereby providing a closed system for transfer of the contents.

In still another embodiment a closed container system is provided where a scale is mounted directly on the receiving valve assembly 210 which supports the adaptor cap and container during emptying and rinsing.

Yet another embodiment includes an air gap over the hopper to provide more accurate draining (and therefore more accurate weighing). The air gap separates the lid 120 of the hopper and the hopper 14; the hopper 14 is associated with load cells 15. Where the receiving valve assembly 210 is associated with the lid 120, and the lid 120 is not associated with the hopper 14, more accurate weight readings of the container can be recorded. Here, the scale or load cells 15 may be associated with the lid 120 to capture start and stop weight readings of the container. Or the receiver comprising a valve assembly 210 may be mounted on the lid 120. In this arrangement, the mechanics of the hopper such as a hose connected to the drain valve which may or may not have fluid remaining in it from the last container do not affect the weight readings of the container. Further, when the receiving valve assembly 210 is directly mounted on the lid 120 the container may be inverted, there is no hose or other conduit between the container and the hopper which also avoids problems of accurate weight recording.

In yet another embodiment, the dispensing assembly of the automated batch making assembly comprises a closed container system with flowmeter to measure liquid.

All of the embodiments where the output of the receiving valve assembly is the hopper, a drain valve maintains a liquid level adequate in the hopper so the pump remains primed and, further, this embodiment avoids foaming the fluids.

What is claimed is:

1. An automated batch making assembly comprising:

a) A controller b) A hopper c) A lid for said hopper d) At least one load cell associated with only one of the lid and the hopper to detect a change in weight of the hopper;

e) A dispensing assembly;

f) Said controller comprising: means to read identification information on a container containing an input; means to display a set of instructions pertaining to a batch; and means to accept and record information from the at least one load cell associated with the hopper;

g) Said controller further comprising means to use the information accepted from the at least one load cell and reconcile account for, and record a weight of said input used from and an amount remaining in said container thereby confirming the input amount complies with the batch instructions;

h) Said dispensing assembly comprising means to remove said input from the container said means comprising at least one of a volume of pressurized gas and a volume of liquid.

2. A method of using the automated batch assembly of claim 1 said method comprising releasing an amount of the pressurized gas into the container thereby causing the input to evacuate from the container.

3. The batch assembly of claim 1 wherein said container further comprises an end and said assembly further comprises a conduit having a first end and a second end, said first end in fluid communication with the volume of pressurized gas, said second end comprising means to dispense said pressurized gas into said end of the container to cause a faster and more complete evacuation of the container in a shorter amount of time.

4. A method of using the automated batch assembly of claim 2 wherein the controller records packaging information located on the container provided by means to read said information, the controller records a weight of the container containing input prior to dispensing for use in the batch according to the batch instructions and records the weight of the container again after dispensing, thereafter reconciling this difference with the amount used said controller recording same, said controller thereby keeping an accurate inventory of the input and a record of the inputs used in the batch.

5. The assembly of claim 1 wherein support for said lid comprises a frame.

6. The assembly of claim 1 wherein said controller further comprises means to store said at least one set of instructions to form a batch.

7. The assembly of claim 1 wherein said controller further comprises means to enter and store said at least one set of instructions to form a batch.

8. A method of using the assembly of claim 6 wherein said controller facilitates access for a user to select a set of instructions to form a batch, captures the empty weight of the hopper, detects and records packaging information from the container containing an input which is associated with the assembly, compares that information to the set of instructions to confirm input identification, when confirmation of compliance between input and instructions is confirmed said controller enables the use of the dispensing assembly, compares readings from the at least one load cell to determine weight of the input dispensed, compares weight of the input dispensed with the weight required by the instructions and generates a message regarding adequacy of the input dispensed, and said controller reconciles and stores the amount of said input used and remaining with the amount required by the instructions.

* * * * *